US006305550B1

(12) United States Patent
Berz

(10) Patent No.: US 6,305,550 B1
(45) **Date of Patent: *Oct. 23, 2001**

(54) METHOD FOR PROCESSING SHEET MATERIAL SUCH AS BANK NOTES USING A SORTING TREE

(75) Inventor: Gregor Berz, Diessen (DE)

(73) Assignee: Giesecke & Devrient GmbH, München (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/101,301

(22) PCT Filed: Nov. 10, 1997

(86) PCT No.: PCT/EP97/06246

§ 371 Date: Jun. 3, 1999

§ 102(e) Date: Jun. 3, 1999

(87) PCT Pub. No.: WO98/21698

PCT Pub. Date: May 22, 1998

(30) Foreign Application Priority Data

Nov. 11, 1996 (DE) ..... 196 46 454

(51) Int. Cl.[7] ..... B07C 5/342
(52) U.S. Cl. ..... 209/534; 700/223
(58) Field of Search ..... 209/534, 583, 209/587; 700/223, 224, 226

(56) References Cited

U.S. PATENT DOCUMENTS 4,025,420 * 5/1977 Horino ..... 209/534
4,179,685 * 12/1979 O'Maley ..... 209/534
4,681,229 * 7/1987 Uesaka et al. ..... 209/534
4,710,963 * 12/1987 Chapman ..... 209/534
4,723,072 * 2/1988 Naruse ..... 209/534
4,787,518 * 11/1988 Yuge et al. ..... 209/534
4,830,742 * 5/1989 Takesako ..... 209/534
4,917,792 * 4/1990 Murakami ..... 209/534
4,928,230 * 5/1990 Kawamura et al. ..... 209/534
4,984,692 * 1/1991 Obara ..... 209/534
5,917,930 * 6/1999 Kayani ..... 209/534
6,074,081 * 6/2000 Smith et al. ..... 364/478.11
6,151,534 * 11/2000 Smith et al. ..... 700/223

FOREIGN PATENT DOCUMENTS

2034286 * 6/1980 (GB) ..... 209/534
0116298 * 9/1979 (JP) ..... 209/534
0247352 * 10/1989 (JP) ..... 209/534
403110695 * 5/1991 (JP) ..... 209/534

* cited by examiner

*Primary Examiner*—Christopher P. Ellis
*Assistant Examiner*—Daniel K Schlak
(74) *Attorney, Agent, or Firm*—Bacon & Thomas

(57) ABSTRACT

The method involves measuring data of a sheet material first being detected by means of a sensor, the sensor then deriving one or more measuring results from the data. Using a sorting tree a sorting class for the sheet material is derived from the measuring results of the sheet material. In each sorting node of the sorting tree a domain is fixed for at least one measuring result. The domains of a measuring result in a sorting node are selected so that they are either a subdomain or equal to the domain of the corresponding measuring result of the assigned, higher sorting node. The sheet material is transported to a destination in accordance with the derived sorting class for the sheet material.

38 Claims, 8 Drawing Sheets

| Level 1 | Level 2 | Level 3 | $ME_1$(DM) | | $ME_2$(%) | |
|---|---|---|---|---|---|---|
| | | | a | b | a | b |
| $K_0$ | | | 5 | 100 | 0 | 100 |
| | $K_{01}$ | | 5 | 10 | 60 | 100 |
| | | $K_{011}$ | 10 | 10 | 60 | 100 |
| | | $K_{012}$ | 5 | 5 | 80 | 100 |
| | $K_{02}$ | | 50 | 100 | 20 | 60 |
| | | $K_{021}$ | 100 | 100 | 40 | 60 |

| | | $ME_1$(DM) | | $ME_2$(%) | |
|---|---|---|---|---|---|
| Level 2 | | a | b | a | b |
| $R^0$ | $R_{01}$ | 50 | 100 | 0 | 20 |
| | $R_{02}$ | 50 | 100 | 60 | 100 |
| | $R_{03}$ | 20 | 20 | 0 | 100 |
| | $R_{04}$ | 5 | 10 | 0 | 60 |
| Level 3 | | a | b | a | b |
| $R^{01}$ | $R_{011}$ | 5 | 10 | 60 | 80 |
| $R^{02}$ | $R_{021}$ | 50 | 50 | 20 | 60 |
| | $R_{022}$ | 100 | 100 | 20 | 40 |

| Measuring Result | Properties | Domain $[a_0^n, b_0^n]$ |
|---|---|---|
| $ME^1$ | Denomination | 5 DM,10 DM, 20 DM, 50 DM,100 DM |
| $ME^2$ | Soiling | 0...100% |
| $ME^3$ | Dogears | 0...100% |
| $ME^4$ | Stains | 0...100% |
| $ME^5$ | Length | 0...30cm |
| $ME^6$ | Position | down, up |
| $ME^7$ | Security thread | present, absent |
| ⋮ | Watermask | |
| $ME^N$ | | o.k., not o.k. |

| Level 1 | Level 2 | Level 3 | $ME_1$(DM) | | $ME_2$(%) | |
|---|---|---|---|---|---|---|
| | | | a | b | a | b |
| $K_0$ | | | 5 | 100 | 0 | 100 |
| | $K_{01}$ | | 5 | 10 | 60 | 100 |
| | | $K_{011}$ | 10 | 10 | 80 | 100 |
| | | $K_{012}$ | 5 | 5 | 80 | 100 |
| | $K_{02}$ | | 50 | 100 | 20 | 60 |
| | | $K_{021}$ | 100 | 100 | 40 | 60 |

FIG. 6

| | | $ME_1$(DM) | | $ME_2$(%) | |
|---|---|---|---|---|---|
| Level 2 | | a | b | a | b |
| $R^0$ | $R_{01}$ | 50 | 100 | 0 | 20 |
| | $R_{02}$ | 50 | 100 | 60 | 100 |
| | $R_{03}$ | 20 | 20 | 0 | 100 |
| | $R_{04}$ | 5 | 10 | 0 | 60 |
| Level 3 | | a | b | a | b |
| $R^{01}$ | $R_{011}$ | 5 | 10 | 60 | 80 |
| $R^{02}$ | $R_{021}$ | 50 | 50 | 20 | 60 |
| | $R_{022}$ | 100 | 100 | 20 | 40 |

FIG. 7

FIG. 10

| Sub-spaces | $ME^1$(DM) | | $ME^2$(%) | |
|---|---|---|---|---|
| | a | b | a | b |
| $U_{01}$ | 50 | 100 | 0 | 20 |
| $U_{02}$ | 50 | 100 | 60 | 100 |
| $U_{03}$ | 20 | 20 | 0 | 20 |
| $U_{04}$ | 20 | 20 | 20 | 60 |
| $U_{05}$ | 20 | 20 | 60 | 100 |
| $U_{06}$ | 5 | 10 | 0 | 20 |
| $U_{07}$ | 5 | 10 | 20 | 60 |

FIG. 11

| Report Node | Subspaces |
|---|---|
| $R_{01}$ | $U_{01}$ |
| $R_{02}$ | $U_{02}$ |
| $R_{03}$ | $U_{03} \cup U_{04} \cup U_{05}$ |
| $R_{04}$ | $U_{06} \cup U_{07}$ |

FIG. 12

| Report Node | Subspaces |
|---|---|
| $R_{01}$ | $U_{01} \cup U_{03} \cup U_{06}$ |
| $R_{02}$ | $U_{04} \cup U_{07}$ |
| $R_{03}$ | $U_{02} \cup U_{05}$ |

FIG. 13

| | | Sorting Rules | | | | | | Report Rules | | | | | | | | |
|---|---|---|---|---|---|---|---|---|---|---|---|---|---|---|---|---|
| | | 1 | 2 | 3 | 4 | 5 | 6 | 1 | 2 | 3 | 4 | 5 | 6 | 7 | | |
| | | $K_{011}$ | $K_{012}$ | $K_{01}$ | $K_{021}$ | $K_{02}$ | $K_0$ | $R_{011}$ | $R_{021}$ | $R_{022}$ | $R_{01}$ | $R_{02}$ | $R_{03}$ | $R_{04}$ | $V_1$ | $V_2$ |
| $ME^1$ (Denomination) | 5 DM | | X | X | | | X | X | | | | | | X | X | |
| | 10 DM | X | | X | | | X | X | | | | | | X | | |
| | 20 DM | | | | | | X | | | | | | X | | | |
| | 50 DM | | | | | X | X | | | X | X | X | | | | X |
| | 100 DM | | | | X | X | X | | X | | X | X | | | | |
| $ME^2$ (Soiling) | [0%,20%] | | | | | | X | | | | X | | X | X | | |
| | [20%,40%] | | | | | X | X | | X | X | | | X | X | | |
| | [40%,60%] | | | | X | X | X | | | X | | | X | X | | X |
| | [60%,80%] | | | X | | | X | X | | | | X | X | | | |
| | [80%,100%] | X | X | X | | | X | | | | | X | X | | X | |
| | | Sorting Class $K_{011}$ | Sorting Class $K_{0121}$ | Sorting Class $K_{01}$ | Sorting Class $K_{0211}$ | Sorting Class $K_{021}$ | Sorting Class $K_{01}$ | Report Message $R_{011}$ | Report Message $R_{021}$ | Report Message $R_{022}$ | Report Message $R_{01}$ | Report Message $R_{02}$ | Report Message $R_{03}$ | Report Message $R_{04}$ | | |

METHOD FOR PROCESSING SHEET MATERIAL SUCH AS BANK NOTES USING A SORTING TREE

BACKGROUND OF THE INVENTION

1. Field of the Invention

This invention relates to a method for processing sheet material such as bank notes.

2. Description of Related Art

A method for processing sheet material such as banknotes by detecting measuring data by means of at least one sensor; deriving measuring results from the detected measuring data, and deriving a sorting class for the sheet material from the measuring results, wherein the step of deriving the sorting class for the sheet material comprises the step of locating a sorting node in a sorting tree in which all of said measuring results are within predetermined ranges of values, herein after referred to as domains, and wherein the sorting tree has the following characteristics:

domain is fixed at least for one measuring result in each sorting node of the sorting tree, for a domain of a measuring result in a sorting node of the sorting tree which is not the uppermost sorting node of the sorting tree, a corresponding domain of this measuring result is present in the assigned, higher sorting node, and the domain of a measuring result in the sorting node is a subdomain or equal to the domain of the corresponding measuring result of the assigned, higher sorting node, is known from DE-OS 27 60 166 for example. Using a singler the sheet material present in a stack is separated into single sheets and delivered to a transport path which transports the singled sheet material through the apparatus.

A plurality of sensor units are mounted along the transport path, each sensor unit detecting measuring data of certain features of the sheet material and combining them into a measuring result. The structure of the sensor units used here is shown in DE-PS 27 60 165. Each sensor unit has a transducer that detects certain features of the sheet material and converts them into an electric signal. This signal is transformed in a signal processing stage. The usually analog signal is generally converted into digital measuring data here. The measuring data are then transformed into yes-or-no information in an evaluation unit of the sensor unit. This information constitutes the measuring result of the sensor unit and is stored, assigned to the particular sheet material, in a main memory.

The main memory is used as a connection for data exchange between the units of the apparatus. It can be accessed by all units which write or read the data necessary for processing the sheet material. One data record is stored in the main memory for a plurality of sheets in each case.

From the measuring results of the sensor units stored in the main memory for each sheet material, evaluation information is first produced in a central evaluation unit. A decision table stored in the evaluation unit is used to determine the destinations for the particular sheet material from the evaluation information. The destinations can be for example stackers for stacking the sheet material or shredders for destroying the sheet material. The destinations for the corresponding sheet material are also stored in the main memory. With reference to the stored information on the destination the sheet material is guided accordingly by the transport unit and the actual deposit checked.

In the known system, the sensor units deliver only yes-or-no information as a measuring result. For sensor units whose measuring results are not restricted to yes-or-no information but equipped with a higher information content, such as the length or width of the sheet material in mm, a dimension figure for the soiling or the like, the production of a decision table for deriving a sorting class or destination for the sheet material is elaborate and relatively quickly becomes too intricate and therefore error-prone.

SUMMARY OF THE INVENTION

On these premises, the invention is based on the problem of proposing a method for processing sheet material which makes it possible to process measuring results with higher information content and to derive a sorting class for the sheet material from these measuring results in a simple and reliable way.

The basic idea of the invention consists in determining the derivation of a sorting class from the particular measuring results obtained for a sheet material with reference to a sorting tree. The structure of the sorting tree, i.e. the number of nodes and the number of hierarchically arranged levels, can be very different depending on the number of desired sorting classes and the particular task to be performed in evaluating the sheet material. Two branches of the inclusion graph of the sorting tree can converge again if they are not disjunct in terms of set theory. A task to be performed can be for example to sort a stack of mixed bank notes according to the particular denomination and according to soiled and unsoiled notes in the particular denomination. In any case a domain is fixed at least for one measuring result in each sorting node of the sorting tree. Except for the uppermost sorting node of the sorting tree, for each domain of a measuring result in a sorting node of the sorting tree a corresponding domain of this measuring result is provided in the assigned, higher sorting node. The domain of the measuring result in the sorting node is either a subdomain or equal to the domain of the corresponding measuring result of the assigned, higher sorting node. A domain is preferably fixed for each measuring result in each sorting node of the sorting tree.

The advantage of the method is that the introduction of domains makes it possible to process measuring results with higher information content. The neat structure of the sorting tree ensures that errors in producing the sorting tree can be very largely avoided, and a sorting class can be derived for the sheet material in a simple and reliable way using the sorting tree. The high flexibility of the sorting tree readily permits adaptation to different tasks to be performed.

BRIEF DESCRIPTION OF THE DRAWINGS

FIG. 6 shows a table of domains of the sorting nodes, FIG. 7 shows a table of domains of the report nodes, FIG. 10 shows a table of subspaces, FIG. 11 shows a table of value spaces of the report nodes for the first way, FIG. 12 shows a table of the value spaces of the report nodes for the second way, FIG. 13 shows a schematic diagram of a rule matrix.

DETAILED DESCRIPTION OF THE PREFERRED EMBODIMENTS

Figure 1:
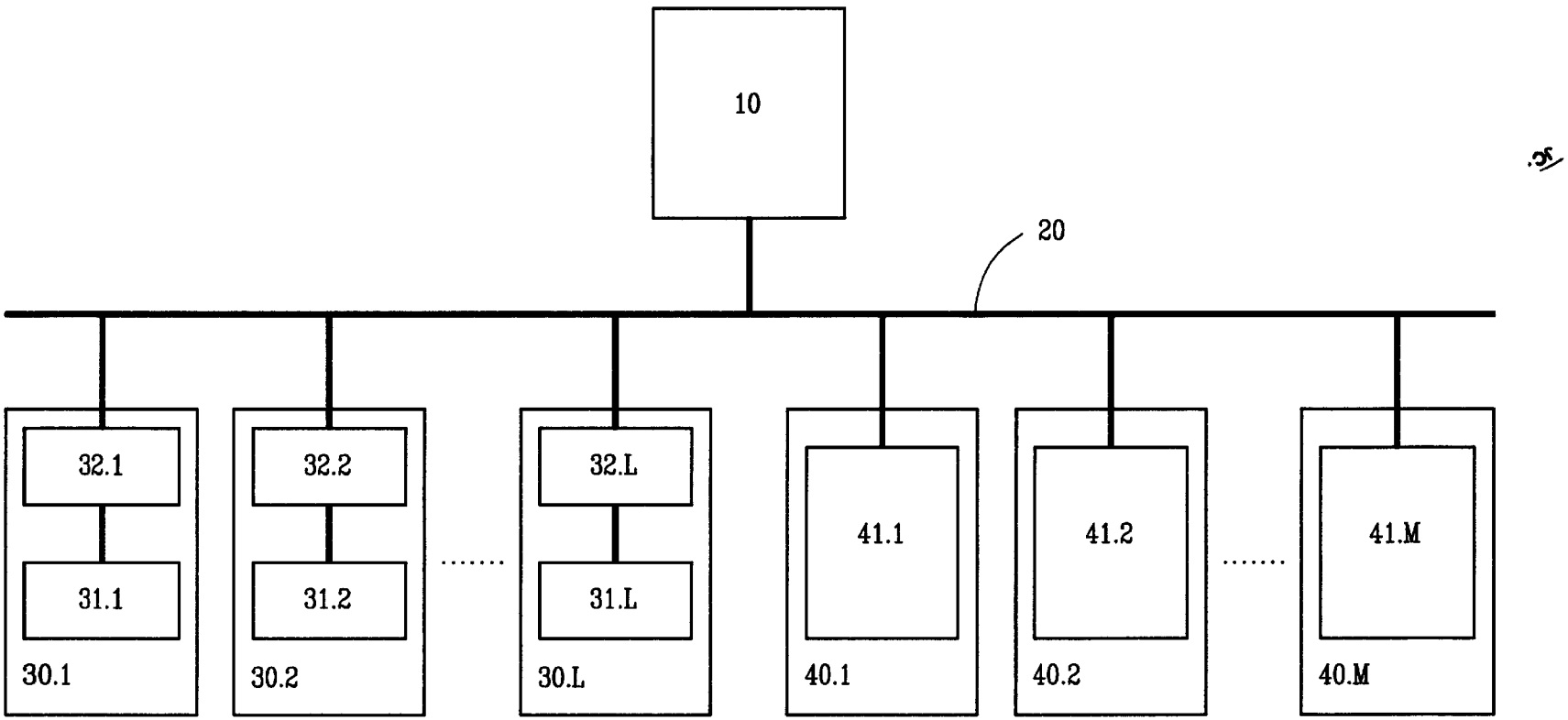
FIG. 1 shows a schematic diagram of an apparatus for processing sheet material.

FIG. 1 shows a schematic diagram of an apparatus for processing sheet material. The apparatus has control device 10 connected via data line 20 with number L of sensors 30.1 to 30.L.

Sensors 30.1 each have transducer 31.1 that detects certain features of the sheet material and converts them into electric signals. These signals are then converted into digital measuring data MD and transferred to evaluation unit 32.1. The latter derives at least one measuring result ME from measuring data MD of transducer 31.1. Measuring results ME derived from sensors 30.L are then transferred to control device 10. Control unit 10 receives number N of measuring results ME from sensors 30.L and derives from measuring results $ME^1$ to $ME^N$ of a sheet material a sorting class for the corresponding sheet material. With reference to the derived sorting class sorting destination 40.m is assigned to the sheet material from number M of sorting destinations. The sorting destinations can be stackers, shredders or the like. The sorting destinations each have detecting device 41.m with which they detect the sheets intended for them.

Figure 2:
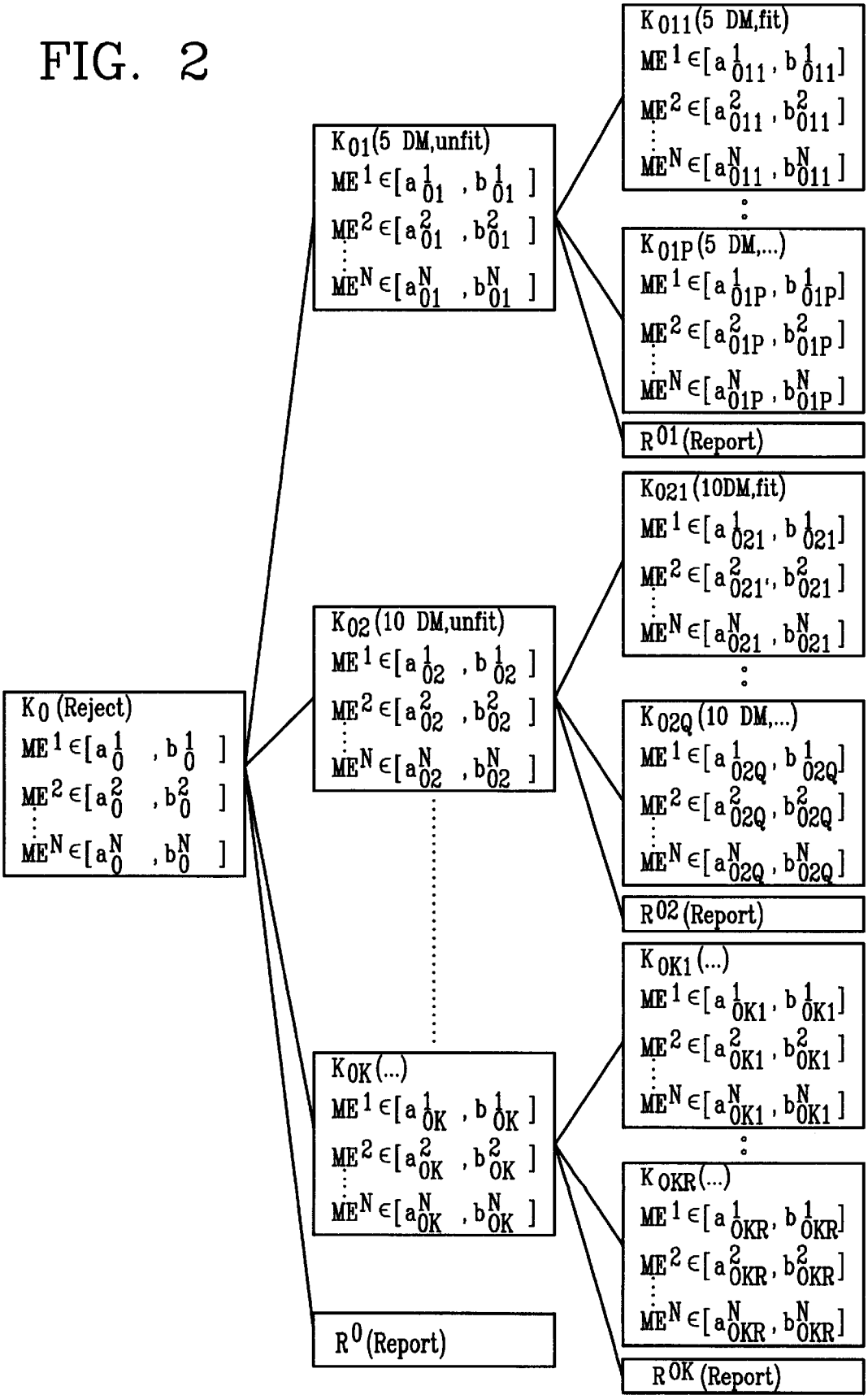
FIG. 2 shows a schematic diagram of a sorting tree.

For deriving the sorting class of a sheet material one first produces a sorting tree which is stored in control device 10. A schematic diagram of a sorting tree is shown in FIG. 2. Starting from uppermost sorting node $K_0$, number K of sorting nodes $K_{01}$ to $K_{0K}$ are assigned to this node. The index of the sorting node describes the level or depth of the sorting tree and the assigned, higher sorting node. The number of indexes stands for the level of the sorting tree or for the depth of the node. One index signifies the first level, two indexes the second level, etc. The uppermost sorting node is on the first level and has the index 0. The nodes assigned to the uppermost sorting node are one level under the uppermost sorting node, i.e. on the second level, and therefore have two indexes. The first index shows the index of the parent node, and the last and second index numbers the assigned nodes from 1 to K. The indexes of the nodes shown on the third level are obtained analogously. Node $K_{02Q}$ therefore designates the Qth node which is assigned to node $K_{02}$.

For each sorting node K of the sorting tree, domains are fixed for each measuring result $ME^1$ to $ME^N$. The domains are intervals with lower limit a and upper limit b. The limits are designated above with the index of the corresponding measuring result and below with the index of the corresponding node. The domains in uppermost node $K_0$ can in principle be selected at will. However, it is advantageous to select the domains so that the corresponding domain of a measuring result comprises the totality of possible measuring results.

The domains of a measuring result in a sorting node which is not uppermost sorting node $K_0$ of the sorting tree are either a subdomain or equal to the domain of the corresponding meameasuring result of the assigned, higher sorting node. For the interval limits of the second level it therefore holds that $a^n_0 >= a^n_{0k}$ and $b^n_{0k} <= b^n_0$. It holds analogously for example for nodes $K_{021}$ to $K_{02Q}$ subordinate to node $K_{02}$ that $a^n_{02} >= a^n_{02q}$ and $b^n_{02q} <= b^n_{02}$.

Since the domains of the individual measuring results thus generally become smaller with the depth of the corresponding sorting nodes and thus describe the sheet material more and more exactly, the nodes constitute a classification of the measuring results into sorting classes. The corresponding sorting class is stated in parentheses after the node designation in FIG. 2. Uppermost sorting node $K_0$ is assigned the sorting class "reject" here, sorting node $K_{02}$ for example the sorting class "10 DM, unfit," and sorting node $K_{021}$ the sorting class "10 DM, fit." The sorting classes each constitute a verbal description of the limits of certain properties as described by the domains of the corresponding node.

Figures 3, 4:
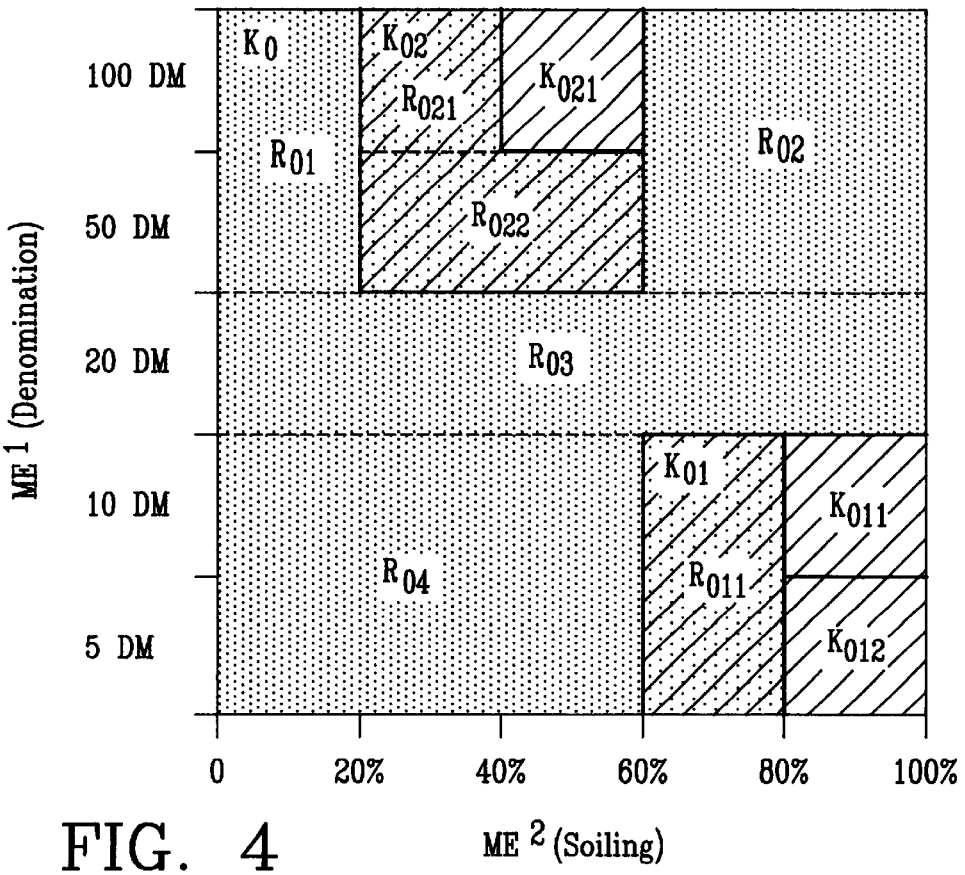
FIG. 3 shows a table of some exemplary properties of the sheet material.
FIG. 4 shows a value space of a two-dimensional sorting tree.

FIG. 3 shows some properties with their possible domains by way of example. The individual domains can have different qualities. The property "denomination" can for example assume five discrete values, while soiling, dog-ears or stains can assume any value in a certain interval between 0 and 100%. Properties such as position, security thread or watermark have only two discrete values.

The designation of the sorting classes is selected here so that one can approximately deduce the domains of at least some properties. The term "fit" can mean for example that the percentages of soiling, dog-ears and stains of the bank note are low. The term "unfit" means that the percentages of these properties are high. Since denomination is a discrete property it is stated with its corresponding value directly in the nodes. The sorting class "reject" is interpreted in such a way that this sheet material cannot be processed properly by the apparatus.

In order to assign a sheet material a sorting class one looks in the sorting tree for the sorting node in the deepest level at which all measuring results $ME^1$ to $ME^N$ of the sheet material are within the corresponding domains of the measuring results of the sorting node. The domains of the sorting nodes are preferably checked recursively, i.e. starting out from uppermost sorting node $K_0$ one checks whether there is a sorting node in the first level at which all measuring results of the sheet material are within the corresponding domains of the measuring results of the sorting node. If this is the case, the sorting nodes assigned to this node in the third level are checked in the same way. One thus analogously determines the node which is located in the deepest level of the sorting tree and at which all measuring results of the sheet material are within the corresponding domains of the measuring results of this sorting node. The sheet material is then assigned the sorting class of the determined sorting node.

If in a level there are several sorting nodes at which all measuring results of the sheet material are within the corresponding domains of the measuring results of the sorting nodes, these sorting nodes are preferably checked in a fixed order.

The sorting nodes are thus generally first checked in the depth of the sorting tree and then the sorting nodes within a level of the sorting tree.

For example, for a sheet material whose measuring results are within the corresponding domains of the measuring results of sorting node $K_{021}$ with sorting classes "10 DM, fit," it is first checked whether the measuring results of the sheet material are within the corresponding domains of the measuring results of sorting nodes $K_{01}$. This is not the case, however, since the value of the denomination is different. Since the domains of nodes $K_{011}$ to $K_{01P}$ subordinate to sorting node $K_{01}$ are generally smaller than or at most equal to the corresponding domains of the measuring results of sorting node $K_{01}$, none of these nodes can describe the sorting class suitable for the sheet material, so that these nodes need not be checked further.

It results for sorting node $K_{02}$ that all measuring results of the sheet material are within the corresponding domains of sorting node $K_{02}$. The sorting tree is thus first processed further in its depth. In the fixed order sorting node $K_{021}$ is then first checked and it is ascertained that all measuring results of the sheet material are within the corresponding domains of the measuring results of sorting node $K_{021}$. Since node $K_{021}$ is not assigned any further sorting nodes here, the sheet material is assigned the sorting class of sorting node $K_{021}$, i.e. "10 DM, fit." There is no firther check of nodes $K_{021}$ to $K_{02Q}$ whose order is after sorting node $K_{021}$.

Further, each sorting node is assigned value space W defined as the Cartesian product of all domains of the measuring results fixed in the sorting node. For sorting node $K_0$ it holds for example that $W(K_0)=[a^1_0, b^1_0]\times[a^2_0, b^2_0]\times\ldots\times[a^N_0, b^N_0]$. One proceeds analogously for all other sorting nodes.

To increase the efficiency of the method further, the value spaces of the sorting nodes which are assigned to another sorting node are selected so that they are disjunct. For example, nodes $K_{01}$ to $K_{0K}$ are assigned to sorting node $K_0$. The domains of sorting nodes $K_{01}$ to $K_{0K}$ are now selected so that the corresponding value spaces of sorting nodes $K_{01}$ to $K_{0K}$ are disjunct. For the value spaces of sorting nodes $K_{011}$ to $K_{01P}$ which are assigned to sorting node $K_{01}$, and the other sorting nodes one proceeds accordingly. The advantage of such a definition of the domains in the sorting nodes is that the check of the sorting tree with reference to the measuring results of a sheet material always leads to the same sorting node independently of the order of processing of the sorting nodes within a level.

Further, each sorting node of the sorting tree can be assigned a report node, which differs from a sorting node only in that it is assigned a report message rather than a sorting class. A domain is also fixed for each measuring result in each report node, the domain of the measuring result in a report node being a subdomain or equal to the domain of the corresponding measuring result of the assigned sorting node.

In contrast to the sorting nodes, a report node cannot be assigned any further nodes. The set of report nodes assigned to a sorting node is designated R in FIG. 2. The upper indexes of the set of report nodes R designate assigned sorting node K. The first indexes of a report node designate, analogously to the sorting node, the higher, assigned sorting node. The last index of a report node numbers the individual report nodes assigned to the higher, assigned sorting node.

Analogously to the sorting node, each report node can be assigned a value space defined as the Cartesian product of all domains of the measuring results fixed in the report node. Each higher sorting node is now assigned a sorting space defined as the union of all value spaces of the sorting nodes assigned to the sorting node, and a report space defined as the union of all value spaces of the report nodes assigned to the sorting node.

The domains of the measuring results in the report nodes are preferably fixed in such a way that the report space and the sorting space of the sorting node are disjunct. The report space is in turn preferably selected additionally in such a way that the union of report space and sorting space of a sorting node yields the value space of the sorting node. This procedure ensures that each sheet material can be assigned either a sorting node or a report node with reference to its measuring results.

If all measuring results of a sheet material are within the corresponding domains of the measuring results of a report node, the sheet material is assigned not only the report message but also the sorting class of the higher sorting node.

If the value spaces of all report nodes of a sorting node are selected to be disjunct, one obtains a definite report message for each sheet material in accordance with the measuring results. However, it is generally unnecessary for the value spaces of all report nodes to be disjunct. In this case it is possible for the measuring results of a sheet material to fall within the value spaces of several report nodes. With the report nodes, in contrast to the sorting nodes, all report nodes assigned to the sorting node are checked, so that in this case the sheet material can also be assigned the report messages of several report nodes.

In the following, an example will be given for a two-dimensional sorting tree, i.e. the sorting tree is based on only two measuring results. FIG. 4 shows the value space of uppermost node $K_0$. The axes show measuring result $ME^1$ (denomination) and measuring result $ME^2$ (soiling). The property "denomination" is a property with five discrete values, while the values of soiling can vary continuously in a range from 0 to 100%.

Figure 5:
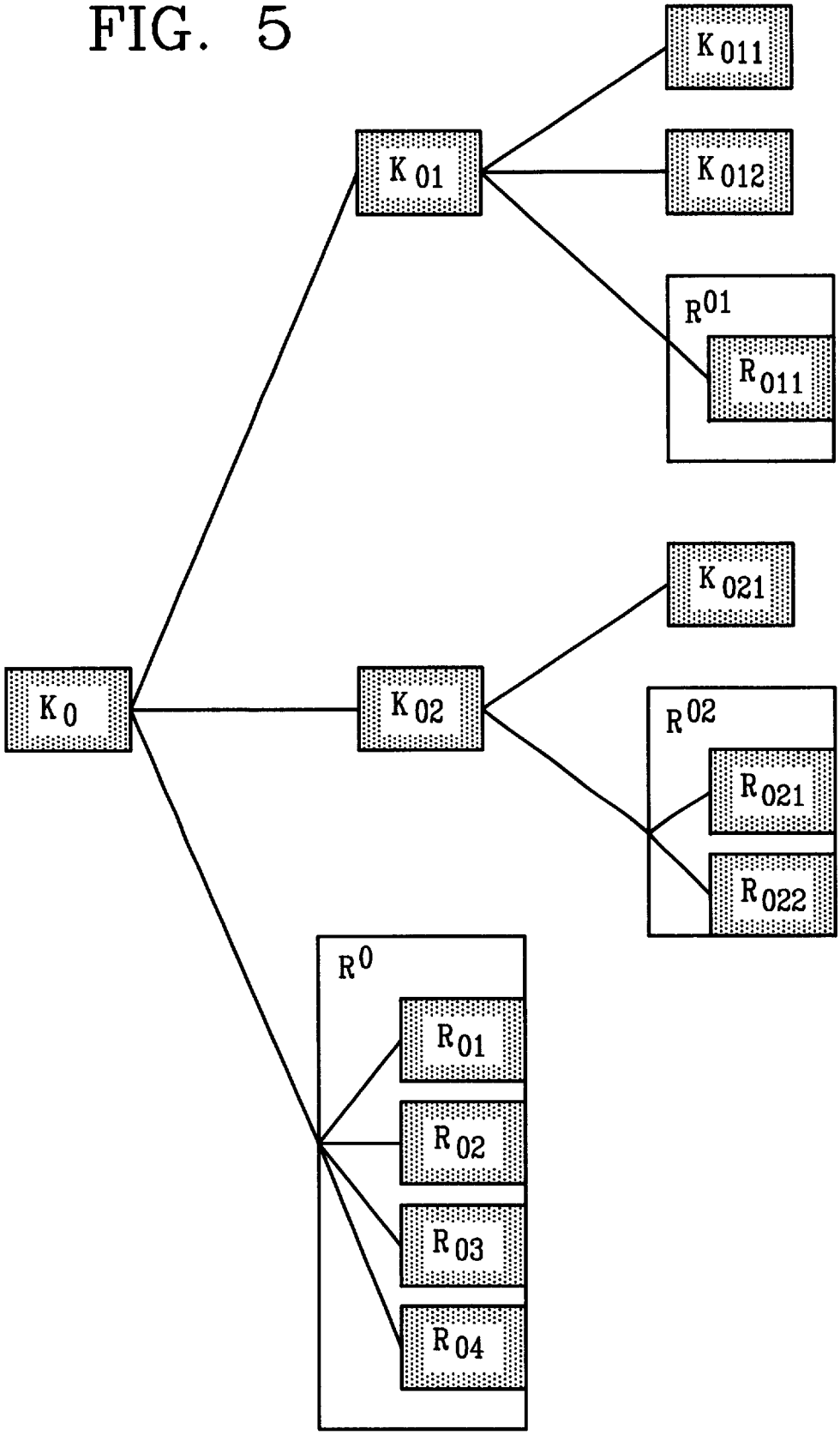
FIG. 5 shows a schematic diagram of the two-dimensional sorting tree.

The corresponding sorting tree is shown in FIG. 5. Starting out from uppermost node $K_0$ this tree has on the second level two sorting nodes $K_{01}$ and $K_{02}$ and a set of report nodes $R^0$ comprising four report nodes $R_{01}$ to $R_{04}$ here. Sorting node $K_{01}$ is assigned on the third level two sorting nodes $K_{011}$ and $K_{012}$ and a set of report nodes $R^{01}$ with one report node $R_{011}$. Sorting node $K_{02}$ is assigned on the third level sorting node $K_{021}$ and a set of report nodes $R^{02}$ with two report nodes $R_{021}$ and $R_{022}$. The domains for measuring results $ME_1$ and $ME_2$ assigned to the sorting nodes are shown in the table in FIG. 6. The domains of measuring results $ME_1$ and $ME_2$ of the report nodes are shown in the table in FIG. 7.

The value spaces of the sorting nodes or report nodes resulting from the domains are shown in FIG. 4. The value space of sorting node $K_0$ is marked by the surrounding square. The value spaces of the sorting nodes of the second level of the sorting tree are shown hatched. The value spaces of the third-level sorting spaces are marked in white, The second-level report nodes are shown in dark gray and the third-level report nodes in light gray.

As one readily sees, the value spaces of the second-level sorting nodes are subsets of the value space of the first-level sorting node, and the value spaces of the third-level sorting nodes assigned to the second-level sorting nodes are in turn subsets of the corresponding value space of the assigned second-level sorting nodes. The required depth relation for the sorting nodes is thus ensured. Further, the value spaces are disjunct within a level.

The value spaces of the report nodes are selected so that they are disjunct from the value spaces of the second-level sorting nodes. Further, the union of the value spaces of all second-level nodes yields the value space of assigned, higher sorting node $K_0$ so that the measuring results of a sheet material are within the value space of either a sorting node or a report node of the second level. This applies analogously to the third-level nodes and the corresponding assigned second-level sorting nodes.

The above-described structure of the sorting tree ensures that the domains of the measuring results in the individual nodes can only be changed in certain areas. In order to prevent certain domains in the sorting nodes from being changed without authorization, the domains and/or the interval limits of the measuring results in each node are each assigned at least partly a security value. By means of this security value one regulates under which conditions the assigned domain and/or interval limit can be changed. These conditions can depend e.g. on the operating state of the apparatus or the identity of the operator. For example, if an operator is not authorized to change domains and/or interval limits of a certain measuring result, this domain and/or interval limit can be protected in each node by a corresponding security value.

A further way of protecting the sorting tree is to assign a security value directly to certain nodes. Via this security value one can regulate for example under which conditions in the node certain domains may be changed. If certain domains are already protected by their own security values, the higher security value can be fixed for the corresponding domain for example. Further, one can regulate by means of the security value under which conditions a node may be removed. It is also possible to regulate via the security value under which conditions a node may be assigned further nodes.

The assignment of security values in the sorting tree thus permits manipulations of the sorting tree to be controlled in a simple way, and performed only by authorized persons with corresponding security values.

In order to avoid errors when changing interval limits of the domains within the sorting tree, the interval limits can be provided at least partly with a certain marking. If a marked interval limit is changed, all other interval limits provided with this marking are automatically also changed accordingly.

This measure makes it possible to restrict the relatively great number of degrees of freedom in selecting the interval limits of the individual domains to a reasonable measure. Additionally, one can also protect the markings of the interval limits from unauthorized changes by assigning a security value.

To simplify the production of a sorting tree further, it is possible first to produce the tree structure of the sorting nodes including the fixing of the domains of the individual measuring results. The report nodes assigned to the sorting nodes can be generated automatically. The basic idea here is that the sorting space and the report space of each sorting node are disjunct and the union of sorting space and report space of a sorting node yields the domain of the sorting node.

Figure 8:
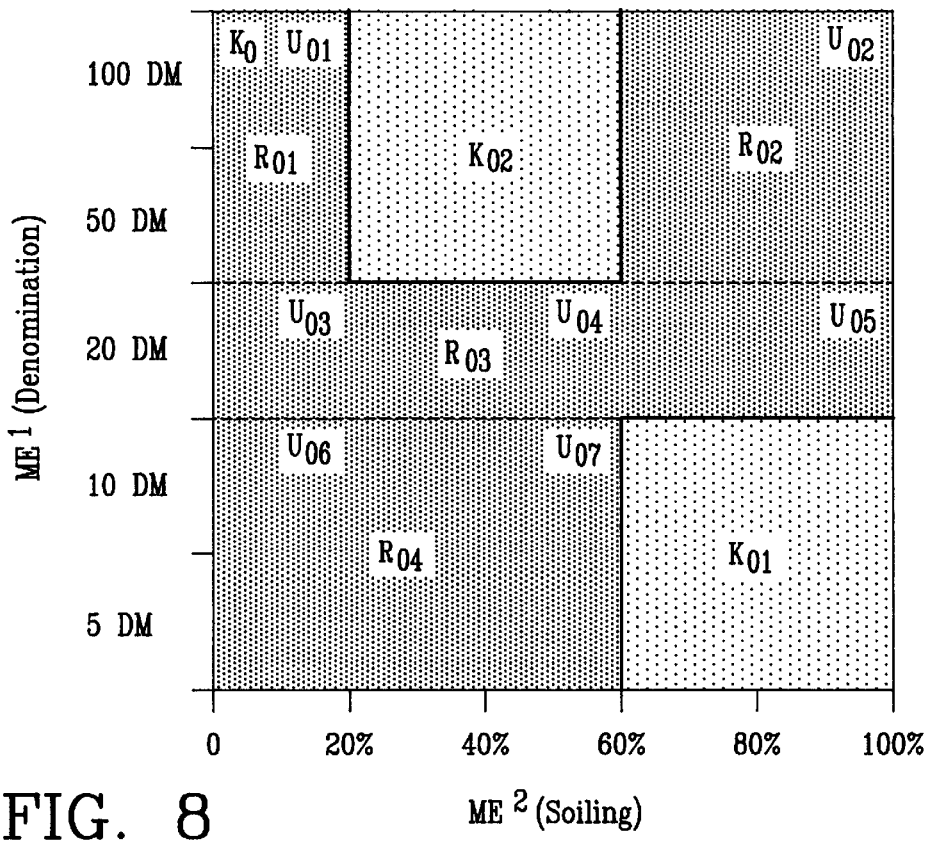
FIG. 8 shows a value space of a two-dimensional sorting tree with a first way of generating report spaces.
Figure 9:
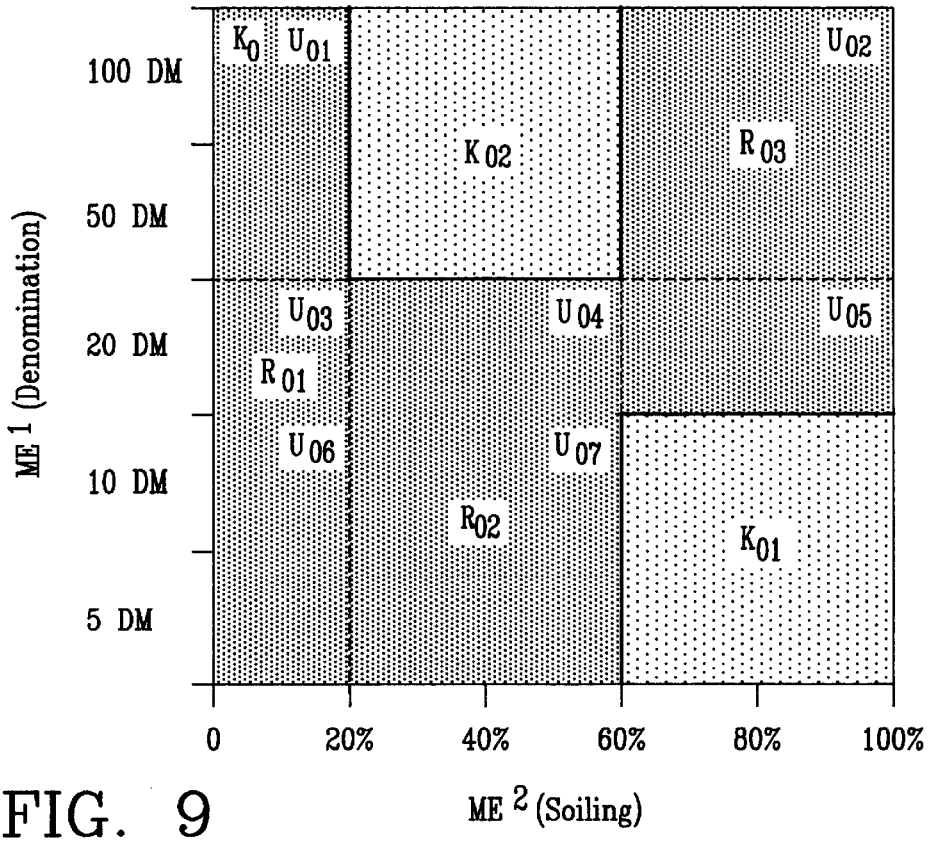
FIG. 9 shows a value space of a two-dimensional sorting tree with a second way of generating report spaces.

Various ways of automatically generating report nodes are shown in FIG. 8 and FIG. 9, the examples corresponding substantially to the example from FIG. 4. As already shown in FIG. 5, sorting node $K_0$ is assigned two sorting nodes $K_{01}$ and $K_{02}$. The report space of sorting node $K_0$ is dark gray in FIG. 8 and the sorting space shown in light gray by the value spaces of assigned sorting nodes $K_{01}$ and $K_{02}$.

For automatically generating the set of report nodes $R^0$ one decomposes the value space of sorting node $K_0$ along the dashed or dotted lines, the lines running in each case along the interval limits of the domains of the measuring results of assigned sorting nodes $K_{01}$ and $K_{02}$. This decomposition yields seven subspaces $U_{01}$ to $U_{07}$ each designated in the upper right corner of the corresponding subspace. The domains of subspaces $U_{01}$ to $U_{07}$ are shown in the table of FIG. 10.

A way of automatically generating the report nodes is now to assign each report node one of these subspaces as the value space, and to select the domains of the measuring results of the report node accordingly.

To keep the number of automatically generated report nodes as low as possible, however, one preferably combines the subspaces suitably before assigning them to a report node.

A first way of combining them is shown in FIG. 8, those subspaces in a report node being combined whose domains are equal with respect to measuring result $ME^1$ (denomination) and whose domains of measuring result $ME^2$ (soiling) are adjacent so that they can be combined into a greater domain. The report nodes arising from the combination of subspaces are shown in tabular form in FIG. 11. The limits between report rules R which determines which domains are included in the report nodes, and therefore the criteria on which the reports are based are shown by dash lines in FIG. 8, while the limits between two subspaces are shown by a dotted line.

In report node $R_{03}$ subspaces $U_{03}$, $U_{04}$ and $U_{05}$ are combined since these subspaces have equal domains with respect to first measuring result $ME^1$ and the domains with respect to measuring result $ME^2$ are adjacent and can thus be combined into a greater domain. In contrast, subspaces $U_{01}$ and $U_{02}$ cannot be combined into a report node since they have equal domains with respect to measuring result $ME^1$ but the domains with respect to measuring result $ME^2$ are not adjacent and can thus not be combined into a greater domain.

A second way of automatically generating report nodes is shown in FIG. 9. In contrast to the first way, one here combines the subspaces for which the domains of measuring result $ME^2$ are equal and the domains of measuring results $ME^1$ are adjacent. Report nodes $R'_{01}$ to $R'_{03}$ resulting from the combination are shown in tabular form in FIG. 12. Here, too, the limits between the report rules are shown analogously by dash lines and the limits between the subspaces by dotted lines.

As one sees from the above example, both the number and the value spaces of the generated report nodes depend on the order in which the subspaces occurring upon decomposition are combined. The automatically generated report message also depends on the order of processing of the measuring results. For example in report node $R_{03}$ in FIG. 8 the automatically generated report message could read "denomination." One can thus derive from the report message only that the note with the sorting class of sorting node $K_0$ was a bank note with a denomination which occurs in no value space of an assigned sorting node. One can draw no conclusion on its soiling from this report message. The automatically generated report message of report node $R'_{01}$ from FIG. 9 could read "soiling" for example. However, this report message does not clearly indicate which denomination the sheet material had.

With this way of automatically generating report nodes it is thus decisive in which order the measuring results are processed. It is possible analogously to generalize this example for higher dimensional value spaces, i.e. for any number N of measuring results. If required, it is also possible for the expert to apply other methods for automatically generating report nodes.

In order to simplify the check of the sorting tree with reference to the measuring results of a sheet material by control unit 10, the sorting tree including the automatically generated report nodes can be mapped onto a suitable form. Such a form is for example the rule matrix shown in FIG. 13.

For producing this rule matrix one decomposes the domain of each measuring result defined in uppermost sorting node $K_0$ into adjacent partitions, the partition limits containing at least interval limits a and b of the domains of the corresponding measuring results of all other nodes. For measuring result $ME^1$ (denomination) from the above example one obtains a decomposition of the domain of sorting node $K_0$ into five partitions with 5 DM, 10 DM, 20 DM, 50 DM and 100 DM. Measuring result $ME^2$ (soiling) is also decomposed into five partitions each comprising the intervals [0%, 20%], [20%, 40%], [40%, 60%], [60%, 80%] and [80%, 100%].

The partition limits are preferably selected so that they are assigned only to one partition. The partitions are thus disjunct and their union yields the domain of sorting node $K_0$ of the corresponding measuring result.

One can now derive the sorting rules of the rule matrix clearly from the domains of the individual measuring results of each sorting node by marking each partition which is at least a subset of the corresponding domain of the measuring result of the sorting node. For sorting node $K_{01}$ the partition 5 DM, 10 DM of measuring result $ME^1$ and the partition [60%, 80%] and [80%, 100%] of measuring result $ME^2$ are marked for example. The union of the marked partitions of a measuring result in turn yields the domain of the measuring result of the corresponding sorting node.

The order of thus produced sorting rules depends on the processing order of the corresponding sorting nodes of the sorting tree. One generally processes the sorting rules corresponding to deeper sorting nodes before the sorting rules corresponding to the assigned, higher sorting nodes. Sorting rules corresponding to a sorting node assigned to another sorting node are disposed in the order of the assigned sorting nodes. Each sorting rule is then assigned the sorting class of the corresponding sorting node.

The report rules are produced and disposed analogously to the sorting rules. Each report rule is assigned the report message of the corresponding report node.

Using such a rule matrix one can determine the sorting class or report message in a simple way in accordance with the measuring results of a sheet material. For example for a sheet material with the measuring results (5 DM, 82%) one first marks the partitions in which the measuring results of the sheet material are located. One obtains measuring result vector $V_1$.

For deriving the sorting class one now compares the sorting rules in their order with measuring result vector $V_1$ up to the rule in which the same partitions are marked as in measuring result vector $V_1$, i.e. in this case rule 2. The sheet material is now assigned the sorting class of sorting rule 2.

One then compares the report rules with measuring result vector $V_1$ and determines all report rules in which the same partitions are marked as for measuring result vector $V_1$. In this example none of the markings of the report rules agrees with the markings of measuring result vector $V_1$ so that the sheet material is not assigned any report message.

For a sheet material with the measuring result (50 DM, 48%) one analogously obtains measuring result vector $V_2$. Comparison with the sorting rules or report rules yields sorting rule 5 and report rule 3 so that the sheet material is assigned the sorting class of sorting rule 5 and the report message of sorting rule 3.

By reason of the described structure of the rule matrix it is thus possible to derive a sorting class or one or more report messages from given measured values for a sheet material in the simplest way. Automatic generation of the rule matrix from a sorting tree ensures that the neat structure of the sorting tree avoids errors in producing the sorting tree and thus in producing the rule matrix.

Along with the described structure of the rule matrix it is also possible for the expert to derive other representations of the sorting tree which can be processed by control device 10 in a simple way. Alternatively to the sorting tree, one can also use a flow chart of the form of representation for the user interface. The forms of representation, sorting tree and flow chart, are equivalent as regards content. The flow chart can thus be translated any time into a set-theoretical sorting tree, and vice versa.

What is claimed is:

1. A method for processing sheet material, comprising the steps of:

detecting measuring data by means of at least one sensor;

deriving measuring results from the detected measuring data, and deriving a sorting class for the sheet material from the measuring results, wherein the step of deriving the sorting class for the sheet material comprises the step of locating a sorting node in a sorting tree in which all of said measuring results are within a predetermined ranges of values, said predetermined ranges being hereinafter referred to as domains, wherein said sorting tree includes a plurality of sorting nodes, one of said sorting nodes being an uppermost sorting node and all other ones of said sorting nodes being directly connected to one upper node and at least one lower node to form said sorting tree, said uppermost sorting node forming a highest level of the sorting tree, sorting nodes in a lower level of the sorting tree having a common number of sorting nodes between said uppermost sorting node and the sorting nodes in the lower level, sorting nodes between one of the sorting nodes in a lower level and the uppermost sorting node being hereinafter referred to as higher sorting nodes assigned to the sorting node in the lower level, and a lowest level of the sorting tree having a greatest number of nodes between the uppermost sorting node and the sorting nodes of the lower level, and wherein said sorting tree has the following characteristics:

a domain is fixed at least for one of said measuring results in each said sorting node of the sorting tree, for said domain of said one of said measuring results in each said sorting node of the sorting tree other than the uppermost sorting node of the sorting tree, a corresponding domain of said one of said measuring results is present in a higher sorting node assigned to each said sorting node, and the domain of said one of said measuring results in each said sorting node of the sorting tree other than the uppermost sorting node is a subdomain or equal to the domain of the corresponding measuring result of the higher sorting node assigned to each said sorting node.

2. The method of claim 1, wherein said sorting tree has the further characteristic that each sorting node is assigned a sorting class.

3. The method of claim 1, wherein said sorting tree has the further characteristic that each sorting node is assigned a value space defined as the Cartesian product of all domains of the measuring results fixed in said sorting node.

4. The method of claim 3, wherein said sorting tree has the further characteristic that the value spaces of all assigned sorting nodes of one of said sorting nodes are disjunct.

5. The method of claim 1, wherein said sorting tree has the further characteristic that at least one sorting node of the sorting tree is assigned at least one report node, wherein if a measuring result is in one of said report nodes, a domain is fixed at least for said one of said report nodes, and the domain of said one of said measuring result in said one of said report nodes is a subdomain or equal to the domain of the corresponding measuring result of a higher sorting node assigned to said at least one sorting node to which said one of said report nodes is assigned.

6. The method of claim 5, wherein said sorting tree has the further characteristic that each said report node is assigned a report message and said report message is generated for each one of said report nodes having a measuring result.

7. The method of claim 5, wherein said sorting tree has the further characteristic that each report node is assigned a value space defined as the Cartesian product of all domains of the measuring results fixed in the report node, and each said sorting node is assigned a value space defined as the Cartesian product of all domains of the measuring results fixed in the sorting node to which the value space is assigned.

8. The method of claim 7, wherein said sorting tree has the further characteristic that each said sorting node is assigned to a sorting space defined as the union of the value spaces of all sorting nodes assigned to the sorting space, and a report space defined as the union of all value spaces of the report nodes assigned to the sorting node to which the value space is assigned.

9. The method of claim 8, wherein said sorting tree has the further characteristic that the report space of one of said sorting nodes is selected so that a union of the report space and the sorting space to which said one of said sorting nodes is assigned yields the value space of said one of said sorting nodes corresponding to the selected report space.

10. The method of claim 9, wherein said sorting tree has the further characteristic that the report space of said one of said sorting nodes is selected so that the report space and sorting space of said one of said sorting nodes are disjunct.

11. The method of claim 10, wherein said sorting tree has the further characteristic that the value spaces of report node of said one of said sorting nodes are disjunct.

12. The method of claim 10, wherein said sorting tree has the further characteristic that the value spaces of all assigned sorting nodes of said one of said sorting nodes are disjunct.

13. The method of claim 5, wherein the report nodes are generated automatically, said report nodes including the domains for each measuring result.

14. The method of claim 13, wherein said sorting tree has the further characteristic that each sorting node is assigned a value space defined as the Cartesian product of all domains of the measuring results fixed in said sorting node, wherein the value space of a sorting node is decomposed into subspaces along the interval limits of the domains of the sorting nodes assigned to the sorting node, and wherein the value spaces of the report nodes, and thus the domains for the measuring results of the report nodes, are formed form the subspaces.

15. The method of claim 14, wherein a plurality of subspaces are combined suitably into a domain of a report node.

16. The method of claim 1, wherein the step of locating the sorting node comprises the step of locating the sorting class of the sorting node in the lowest level of the sorting tree at which all measuring results of the sheet material are within the corresponding domains of the measuring results of the lowest level sorting node, and further comprising the step of assigning said sorting class to the sheet material.

17. The method of claim 16, wherein the step of locating the sorting node comprises the step of recursively checking whether said measuring results are within the domains of the sorting nodes.

18. The method of claim 17, wherein the step of locating the sorting node comprises the step of checking in a fixed order whether said measuring results are within the domains of the sorting nodes of a level.

19. The method of claim 16, wherein said sorting tree has the further characteristic that at least one sorting node of the sorting tree is assigned to at least one report node, wherein a domain is fixed at least for one of said measuring results in each said report node, and the domain of said one of said measuring results in the report node is a subdomain or equal to the domain of the corresponding measuring result of the higher sorting node assigned to said at least one sorting node, and each report node is assigned a report message, and further comprising the step of assigning the sheet material the report message of the at least one report node assigned to the sorting node corresponding to the sorting class of the sheet material.

20. The method of claim 19, wherein the step of locating the sorting node comprises the step of checking in a fixed order whether said measuring results are within the domains of the report nodes of the at least one sorting node.

21. The method of claim 1, further comprising the step of assigning a security value to at least one of the domains or to an internal limit of the measuring results in at least one of said nodes of the sorting tree.

22. The method of claim 21, wherein the assigned domain or interval limit may be changed under conditions defined by the security value.

23. The method of claim 1, further comprising the step of assigning a security value to at least one of said nodes.

24. The method of claim 23, wherein the domains assigned to the node may be changed under conditions defined by the security value of a respective one of said nodes.

25. The method of claim 23, wherein respective ones of said nodes may be removed under conditions defined by the security value of the node.

26. The method of claim 23, wherein respective ones of said nodes may be assigned further nodes under conditions defined by the security value of the respective ones of said nodes.

27. The method of claim 1, further comprising the step of assigning a marking to at least one interval limit of a domain of a measuring result.

28. The method of claim 27, wherein at least one of said interval limits may be changed, and further comprising the step of, upon a change in an interval limit assigned a marking, changing all other interval limits assigned the same marking.

29. The method of claim 27, wherein at least one of the markings is assigned a security value.

30. The method of claim 29, wherein the markings may be changed under conditions defined by the security value of the markings.

31. The method of claim 1, wherein the sorting tree is mapped onto a rule matrix, wherein rules in said rule matrix determine which domains are included in each report node or sorting node.

32. The method of claim 1, wherein the domains of the measuring results of the uppermost sorting node are decomposed into partitions, the partition limits containing at least the interval limits of the domains of the corresponding measuring results of all other nodes.

33. The method of claim 32, further comprising the step of setting up a rule matrix by assigning each node of the sorting tree a rule for determining which domains are included in each said node, said assigning step comprising the steps of marking the partitions of the measuring results which are at least subsets of the domain of the corresponding measuring result of the node, and using said marks to assign said rule to said node.

34. The method of claim 33, further comprising the step of disposing the rules of the sorting nodes in an order, the rules of the assigned sorting nodes being disposed in the order of the assigned sorting nodes and before the rules of the higher sorting nodes.

35. The method of claim 34, wherein each rule of a respective said sorting node is assigned the sorting class of the sorting node.

36. The method of claim 35, wherein the sheet material is assigned the sorting class of a first rule in the order in which at least the partitions are marked in which all measuring results of the sheet material are located.

37. The method of claim 33, wherein each rule of a report node is assigned the report message of the report node.

38. The method of claim 37, wherein the sheet material is assigned the report messages of the rules in which at least the partitions are marked in which all measuring results of the sheet material are located.

* * * * *